US008137521B2

(12) United States Patent
Kim et al.

(10) Patent No.: US 8,137,521 B2
(45) Date of Patent: Mar. 20, 2012

(54) CARBON NANOTUBE SHEET

(75) Inventors: Yong Hyup Kim, Seoul (KR); Eui Yun Jang, Seoul (KR)

(73) Assignee: SNU R&DB Foundation, Seoul (KR)

( * ) Notice: Subject to any disclaimer, the term of this patent is extended or adjusted under 35 U.S.C. 154(b) by 869 days.

(21) Appl. No.: 12/194,361

(22) Filed: Aug. 19, 2008

(65) Prior Publication Data

US 2010/0044215 A1 Feb. 25, 2010

(51) Int. Cl.
*C25D 13/12* (2006.01)

(52) U.S. Cl. ..... 204/491; 204/547; 204/624; 204/643

(58) Field of Classification Search ..... 204/491, 204/624, 547, 643
See application file for complete search history.

(56) References Cited

U.S. PATENT DOCUMENTS

| | | | | |
|---|---|---|---|---|
| 3,434,952 | A * | 3/1969 | Tsou | 204/496 |
| 7,014,743 | B2 * | 3/2006 | Zhou et al. | 204/547 |
| 7,799,196 | B2 * | 9/2010 | Sandhu | 204/490 |
| 7,938,996 | B2 * | 5/2011 | Baughman et al. | 264/108 |

FOREIGN PATENT DOCUMENTS

| | | |
|---|---|---|
| KR | 10-1077291 | 10/2011 |

OTHER PUBLICATIONS

Ko et al., "Electrospinning of Continuous Carbon Nanotube-Filled Nanofiber Yarns", Adv. Mater., 15, No. 14, pp. 1161-1165 (2003).
Liu et al., "Controlled Growth of Super-Aligned Carbon Nanotube Arrays for Spinning Continuous Unidirectional Sheets with Tunable Physical Properties", Nano Letters, vol. 8, No. 2, pp. 700-705 (2008).
Ma et al., "Directly Synthesized Strong, Highly Conducting, Transparent Single-Walled Carbon Nanotube Films", Nano Letters, vol. 7, No. 8, pp. 2307-2311 (2007).

* cited by examiner

*Primary Examiner* — Kishor Mayekar
(74) *Attorney, Agent, or Firm* — Knobbe, Martens, Olson & Bear LLP

(57) ABSTRACT

An apparatus for forming a carbon nanotube sheet is provided. The apparatus includes a bath and a driving unit wherein the bath has a bottom surface and is configured to contain a carbon nanotube colloidal solution. The bottom surface is capable of having an array of capillary tubes. The driving unit is configured to drive at least a part of the carbon nanotube colloidal solution out of the bath through the array of capillary tubes.

19 Claims, 4 Drawing Sheets

CARBON NANOTUBE SHEET

TECHNICAL FIELD

The present disclosure relates generally to carbon nanotube sheets.

BACKGROUND

Recently, carbon nanotubes (CNTs) have attracted great attention in many research fields due to their superior mechanical, thermal and electrical properties. Although tremendous progress has been made in the synthesis of the CNTs, a major challenge remains in the search for an effective means to bridge the gap between the raw CNTs and the engineering materials/structures. In order to translate the superior properties of the CNTs to meso- or macro-scale structures, considerable efforts are being devoted to the development of CNT assemblies.

SUMMARY

Apparatus and corresponding methods for forming carbon nanotube sheets are provided. In one embodiment, an apparatus for forming a carbon nanotube sheet includes a bath and a driving unit. The bath has a bottom surface and is configured to contain a carbon nanotube colloidal solution. The bottom surface is capable of having an array of capillary tubes. The driving unit is configured to drive at least a part of the carbon nanotube colloidal solution out of the bath through the array of capillary tubes.

In another embodiment, a method for forming a carbon nanotube sheet includes disposing a carbon nanotube colloidal solution in a bath, the bath having capillary tubes formed through a bottom surface of the bath, and driving at least a part of the carbon nanotube colloidal solution out of the bath through the capillary tubes, to thereby grow the carbon nanotube sheet.

The Summary is provided to introduce a selection of concepts in a simplified form that are further described below in the Detailed Description. This Summary is not intended to identify key or essential features of the claimed subject matter, nor is it intended to be used in determining the scope of the claimed subject matter.

DETAILED DESCRIPTION

Figure 1:
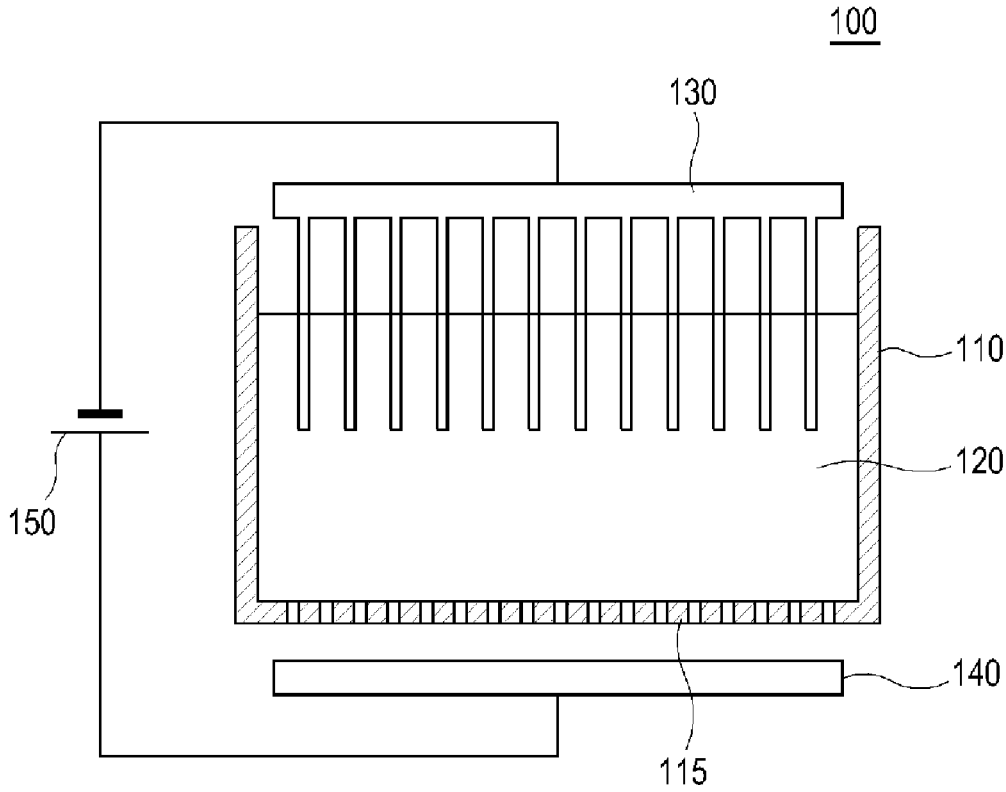
FIG. 1 shows a schematic diagram of an illustrative embodiment of an apparatus for forming a CNT sheet.

In the following detailed description, reference is made to the accompanying drawings, which form a part hereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the components of the present disclosure, as generally described herein, and illustrated in the Figures, may be arranged, substituted, combined, and designed in a wide variety of different configurations, all of which are explicitly contemplated and make part of this disclosure.

In one embodiment, a carbon nanotube (CNT) sheet may include an array of CNTs. CNTs in a CNT sheet may be unidirectionally aligned in parallel, and joined end-to-end with each other, to form a 2-dimensional type CNT structure such as a continuous thin film. In general, CNT sheets may have high transparency as well as high conductivity. Many potential applications for the CNT sheets may include, e.g., polarizers, transparent conductive films (TFCs), armors and polarized light sources, etc. Further, CNT sheets may be condensed into CNT yarns, which in general show high tensile strength as well as high Young's modulus. Such condensation may be accomplished, e.g., by passing CNT sheets through volatile solutions or by twisting CNT sheets.

FIG. 1 shows a schematic diagram of an illustrative embodiment of an apparatus 100 for forming a CNT sheet. The apparatus 100 may include a bath 110 configured to contain a CNT colloidal solution 120. An electrode 130 may be disposed above the bottom surface of the bath 110 such that when the bath 110 contains the CNT colloidal solution 120, at least a part of the electrode 130 is immersed into the CNT colloidal solution 120. Further, a metal plate 140 may be disposed below the bath 110, and more specifically, below the bottom surface of the bath 110. The electrode 130 and the metal plate 140 may be electrically coupled to a power source 150, which may bias the electrode 130 and the metal plate 140 to generate an electric field therebetween. Although not shown in FIG. 1, the apparatus 100 may further include a motorized device capable of moving the metal plate 140 in a vertical direction. In one embodiment, the apparatus 100 may also include a heater (not shown).

In one embodiment, the CNT colloidal solution 120 contained in the bath 110 may include electrically (e.g., negatively) charged CNTs dispersed in a solvent. The electrically charged CNTs may be formed, e.g., by a dry or wet oxidation process, which may apply charged functional groups on the surfaces of the CNTs. In one embodiment, the oxidization process may be performed by sonicating CNTs in a nitric acid at 50 degrees Celsius for 30 minutes. The CNTs may then be neutralized with deionized water, and trapped on a membrane filter by using a vacuum filtration method. In order to prepare the CNT colloidal solution from the CNTs, in one embodiment, the CNTs on the filter may be dried in a vacuum oven chamber at 80 degrees Celsius for 48 hours, and then solubilized in a solvent by sonication for 10 hours. The solvent may be, e.g., 1,2-Dichlorobenzene (1,2-DCB). However, it would be readily appreciated that any other appropriate solvent, such as N,N-dimethylformamide (N,N-DMF), may be used instead, without departing from the claimed scope, and accordingly the claimed subject matter is not limited in these respects.

Figure 2:
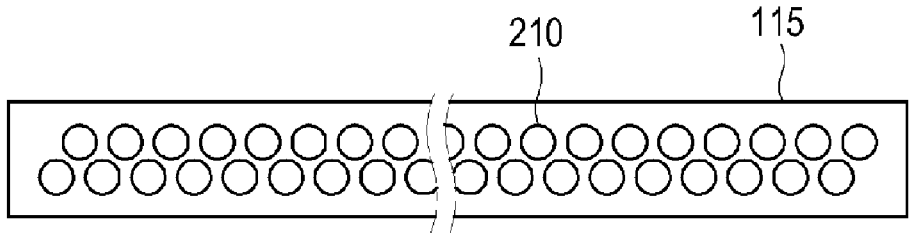
FIG. 2 shows a schematic diagram of an illustrative embodiment of a bottom surface of a bath.

In one embodiment, the bath 110 may be made of an electrical insulation material, such as a ceramic. The bath 110 may resemble a hollow rectangular parallelepiped with its top surface opened, without limiting the claimed scope. In one embodiment, a horizontal cross-section of the bath 110 may present an elongated rectangular shape. For the purpose of illustration, FIG. 2 shows an exemplary schematic diagram of an illustrative embodiment of the bottom surface 115 of the bath 110. Referring to FIG. 2, the bottom surface 115 may include an array of capillary tubes 210 penetrating through the bottom surface 115. In one embodiment, the capillary tubes 210 may be formed by, e.g., applying laser on the bottom surface 115 of the bath 110. However, such embodiment is not intended to limit the claimed scope, but various other methods may be used to form the capillary tubes 210 without departing from the claimed scope. For example, it is also possible to use a conic tip(s) to punch the capillary tubes 210, possibly with melting of the bath 110.

In one embodiment, the capillary tubes 210 may be arranged in a zigzag pattern, but however, the capillary tubes 210 may also have other patterns without departing from the claimed scope, and accordingly the claimed subject matter is not limited in this respect. The zigzag arrangement may contribute at minute intervals between the capillary tubes 210. The size of the capillary tubes 210 may be determined in consideration of the surface tension and the density of the CNT colloidal solution 120. For example, the size of the capillary tubes 210 may be determined so that the weight of the CNT colloidal solution 120 does not exceed the surface tension of the CNT colloidal solution 120 at the capillary tubes 210. The intervals between the capillary tubes 210 may relate to the density of the resulting CNT sheet. Thus, in one embodiment, the intervals may be determined based at least in part on the desired characteristics of the CNT sheet. For example, in order to obtain a denser CNT sheet, the capillary tubes 210 may be arranged at smaller intervals. As another example, in order to obtain a more transparent CNT sheet, the capillary tubes 210 may be arranged at larger intervals.

In one embodiment, the electrode 130 may be made of platinum, and may have a comb shape teeth which may be immersed in the CNT colloidal solution 120. The location of the electrode 130 may be adjustable, e.g., according to the amount of the CNT colloidal solution 120. The metal plate 140 may have, e.g., an elongated strip shape. It would be readily appreciated that the above descriptions are provided only for the purpose of illustration, and that the details of the electrode 130 and the metal plate 140 may be modified by one of ordinary skill in the art without departing from the claimed scope.

In one embodiment, the power source 150 may be configured to provide a potential difference between the electrode 130 and the metal plate 140. For example, a negative voltage may be applied on the electrode 130, while a positive voltage on the metal plate 140. Such potential difference may result in the application of an electric field on the CNT colloidal solution 120, and the electric field may drive the CNT colloidal solution 120 out of the bath 110 through the capillary tubes 210. In other words, the electrode 130, the metal plate 140 and the power source 150 may constitute an electric driving unit to drive the CNT colloidal solution 120 out of the bath 110.

In one embodiment, the CNTs in the CNT colloidal solution 120 driven out of the bath 110 may be used to grow a CNT sheet on the metal plate 140. In this case, the motorized device of the apparatus 100 (not shown) may serve to move the metal plate 140 away from the bath 110, as the CNT sheet grows. Note that once the CNT sheet starts growing on the metal plate 140, the CNT sheet may also serve as an electrode, due to its electrical conductivity.

In one embodiment, the heater in the apparatus 100 may be configured to heat the CNT colloidal solution 120 as it is driven out of the bath 110. This may assist drying the solvent of the driven-out CNT colloidal solution 120, thereby leaving the CNTs behind. In one embodiment, the driven-out CNT colloidal solution 120 may be heated to the boiling point of the solvent. Note that the heater may not necessarily be a separate part from the components shown in FIG. 1. For example, the metal plate 140 may be designed to have a self-heating capability without departing from the claimed scope, and accordingly, the claimed subject matter is not to be limited in these respects.

Figure 3A:
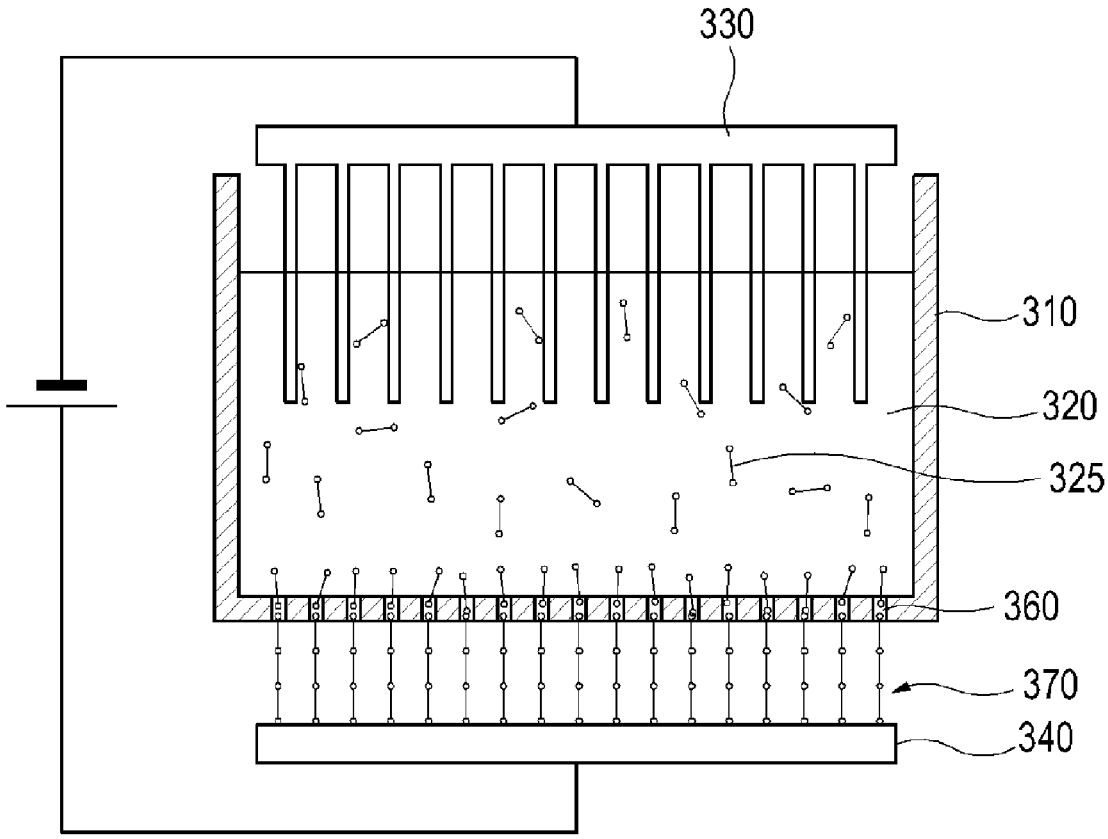
FIGS. 3A and 3B are schematic diagrams depicting the operating an apparatus for forming a CNT sheet in accordance with one illustrative embodiment.
Figure 4:
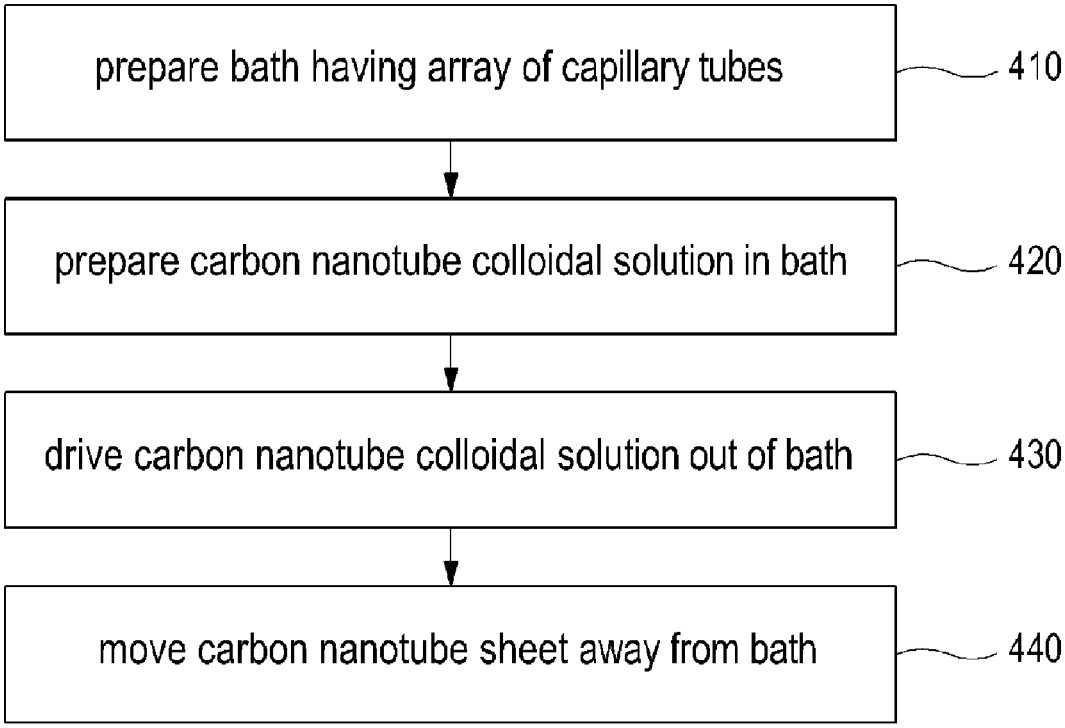
FIG. 4 is a flow chart of an illustrative embodiment of a method for forming a CNT sheet.

FIG. 4 is a flow chart of an illustrative embodiment of a method for forming a CNT sheet. In the illustrative embodiment, a bath may be prepared first (FIG. 4, block 410). Referring to FIG. 3A, the bath 310 may have an array of capillary tubes 360 penetrating through the bottom surface 315 of the bath 310. In one embodiment, the capillary tubes 360 may be arranged in a zigzag pattern as shown in FIG. 2.

Referring again to FIG. 4, then, a CNT colloidal solution may be prepared in the bath 310 (FIG. 4, block 420). Referring to FIG. 3A, the CNT colloidal solution 320 in the bath 310 may include electrically charged CNTs 325. In one embodiment, a dry or wet oxidation process may be performed to electrically charge the CNTs 325.

Referring again to FIG. 4, next, at least a part of the CNT colloidal solution 320 may be driven out of the bath 310 (FIG. 4, block 430), possibly through the array of capillary tubes 360. In one embodiment, an electric field may be applied on the CNT colloidal solution 320 for that purpose. The electric field may be generated by applying DC voltage between an electrode 330 and a metal plate 340. With an electrophoretic process, the density of the CNTs 325 may be increased at the capillary tubes 325, which may contribute to formation of CNT assemblies, such as CNT ropes or CNT sheets. It would be readily appreciated that the intervals between the parallel streams of the CNT colloidal solution 320 passing through the capillary tubes 360 may correspond to the intervals between the capillary tubes 360.

As the CNT colloidal solution 320 is driven out of the bath 310, a CNT sheet 370 may be grown from the CNT colloidal solution 320. In one embodiment, the driven-out CNT colloidal solution 320 may be heated to vaporize or boil away the solvent, thereby leaving the CNTs 325 behind, and the CNTs 325 may constitute CNT colloids, CNT ropes, and in turn the CNT sheet 370. The CNTs 325 in the driven-out CNT colloidal solution 320 may be guided by an electric field to grow the CNT sheet 370. For example, the driven-out CNTs 325 may be initially guided to the metal plate 340 to make a CNT sheet 370 start growing on the metal plate 340. Once the CNT sheet 370 starts growing on the metal plate 340, the CNTs 325 may be guided to the upper ends of the CNT sheet 370 instead of to the metal plate 340, since the CNT sheet 370, which is electrically coupled to the metal plate 340, may be acting effectively as an electrode also. Then, the guided CNTs 325 may be used to further grow the CNT sheet 370. The CNT sheet 370 may be formed freestanding on the metal plate 340 without any other supporting structures.

In one embodiment, when the CNTs 320 make contact with the CNT sheet 370, electric charges of the CNTs 320 may be transferred through the contact point to the CNT sheet 370. A charge transfer may strengthen the adhesion of the CNTs 320 to the CNT sheet 370, with the result being that the durability of the produced CNT sheet 370 accordingly increases.

Figure 3B:
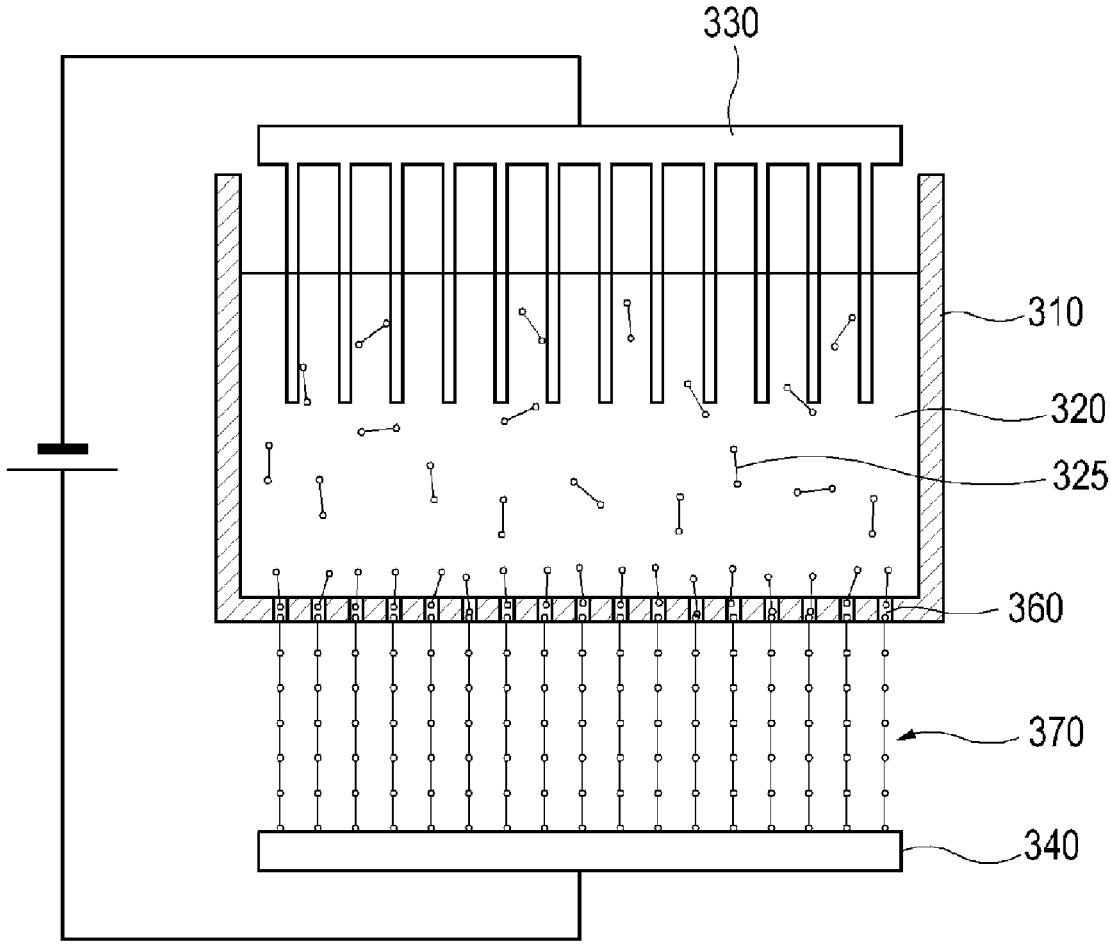

Referring again to FIG. 4, in one embodiment, as the CNT sheet 370 grows on the metal plate 340, the metal plate 340 (and accordingly, the grown CNT sheet 370) may be moved away from the bath 310 (FIG. 4, block 440). The magnitude of the DC voltage may also be varied according to the movement of the metal plate 340. FIG. 3B illustrates a further grown CNT sheet 370 in a state where the metal plate 340 is moved away from the bath 310 compared to the state in FIG. 3A, in accordance with one embodiment. The operations in blocks 430 and 440 may continue until a desired length of CNT sheet 370 is formed.

For this and other processes and methods disclosed herein, one skilled in the art will appreciate that the functions performed in the processes and methods may be implemented in different order. Further, the outlined operations are only provided as examples. That is, some of the operations may be optional, combined into fewer operations, or expanded into additional operations without detracting from the spirit and scope of the disclosed embodiments.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An apparatus for forming a carbon nanotube sheet, comprising:

a bath including an interior surface and an exterior surface, wherein the interior surface of the bath is configured to contain a carbon nanotube colloidal solution;

an array of capillary tubes extending from the interior surface of the bath through the exterior surface of the bath; and a driving unit comprising:

a metal plate disposed external to the bath proximate to the exterior surface of the bath;

an electrode disposed opposite the metal plate, wherein the electrode and the metal plate are configured to cooperatively generate an electric field across the array of capillary tubes when power is coupled to the electrode and the metal plate effective to drive at least a portion of the carbon nanotubes from the carbon nanotube colloidal solution out of the bath through the array of capillary tubes.

2. The apparatus of claim 1, wherein the capillary tubes are arranged in a zigzag pattern.

3. The apparatus of claim 1, wherein the bath comprises an electrical insulation material.

4. The apparatus of claim 1, wherein the electrode is made from platinum.

5. The apparatus of claim 1, wherein the apparatus further comprises a motorized device configured to move the metal plate in a vertical direction.

6. The apparatus of claim 1, wherein the apparatus further comprises a heater configured to heat the carbon nanotube colloidal solution driven out of the bath.

7. The apparatus of claim 1, wherein the capillary tubes are sized such that the weight of the carbon nanotube colloidal solution does not exceed the surface tension of the carbon nanotube colloidal solution at the capillary tubes.

8. The apparatus of claim 1, wherein the electrode is comb-shaped.

9. The apparatus of claim 1, wherein the electrode is immersed in the carbon nanotube colloidal solution.

10. A method for forming a carbon nanotube sheet comprising:

disposing a carbon nanotube colloidal solution in an interior surface of a bath, the bath having capillary tubes extending from the interior surface of the bath through an exterior surface of the bath; and driving at least a portion of the carbon nanotubes in the carbon nanotube colloidal solution out of the bath through the capillary tubes by applying a voltage between an electrode and a metal plate effective to produce an electric field across the capillary tubes, wherein the metal plate is disposed external to the bath proximate to the capillary tubes, wherein the electrode is disposed opposite the metal plate, and wherein driving at least the portion of the carbon nanotubes in the carbon nanotube colloidal solution through the capillary tubes facilitates formation of a carbon nanotube sheet on the metal plate.

11. The method of claim 10, wherein the formation of the carbon nanotube sheet comprises forming a carbon nanotube sheet unidirectionally aligned in parallel, and joined end-to-end with each other facilitating formation of a 2-dimensional carbon nanotube sheet structure.

12. The method of claim 10 further comprising arranging the capillary tubes in a zigzag pattern.

13. The method of claim 10, wherein the disposing the carbon nanotube colloidal solution comprises disposing a colloidal solution of electrically charged carbon nanotubes.

14. The method of claim 13, wherein the disposing the colloidal solution of electrically charged carbon nanotubes comprises utilizing an oxidation process to facilitate an electrical charge on the carbon nanotubes.

15. The method of claim 10, wherein the driving at least a portion of the carbon nanotubes in the carbon nanotube colloidal solution out of the bath through the capillary tubes comprises moving away the carbon nanotube sheet from the bath, as the carbon nanotube sheet is being formed.

16. The method of claim 15, wherein moving away the carbon nanotube sheet comprises varying the voltage applied between the electrode and the metal plate as the carbon nanotube sheet moves away from the bath.

17. The method of claim 10, wherein the driving at least a portion of the carbon nanotubes in the carbon nanotube colloidal solution out of the bath through the capillary tubes comprises heating the carbon nanotube colloidal solution driven out from of the bath.

18. The method of claim 17, wherein the heating comprises heating the carbon nanotube colloidal solution to boil away a solvent in the carbon nanotube colloidal solution.

19. The method of claim 10, wherein the carbon nanotube sheet has a unidirectional and freestanding structure without any other supporting structures.

* * * * *

UNITED STATES PATENT AND TRADEMARK OFFICE

CERTIFICATE OF CORRECTION

PATENT NO. : 8,137,521 B2
APPLICATION NO. : 12/194361
DATED : March 20, 2012
INVENTOR(S) : Kim et al.

It is certified that error appears in the above-identified patent and that said Letters Patent is hereby corrected as shown below:

In Column 2, Line 14, delete "(TFCs)," and insert -- (TCFs), --, therefor.

In Column 5, Line 28, in Claim 1, delete "bath;" and insert -- bath; and --, therefor.

Signed and Sealed this
Second Day of October, 2012

David J. Kappos

David J. Kappos
*Director of the United States Patent and Trademark Office*